US010329824B2

(12) United States Patent
Takehara et al.

(10) Patent No.: US 10,329,824 B2
(45) Date of Patent: Jun. 25, 2019

(54) VEHICLE DOOR GLASS LIFTING DEVICE WITH FOREIGN OBJECTION DETECTION

(71) Applicant: Johnan Manufacturing Inc., Nagano (JP)

(72) Inventors: Hideaki Takehara, Nagano (JP); Masakane Yoshizawa, Nagano (JP); Yasuhiro Saito, Nagano (JP)

(73) Assignee: JOHNAN MANUFACTURING INC., Nagano (JP)

( * ) Notice: Subject to any disclaimer, the term of this patent is extended or adjusted under 35 U.S.C. 154(b) by 310 days.

(21) Appl. No.: 15/508,197

(22) PCT Filed: Feb. 26, 2015

(86) PCT No.: PCT/JP2015/055649
§ 371 (c)(1),
(2) Date: Mar. 2, 2017

(87) PCT Pub. No.: WO2016/038906
PCT Pub. Date: Mar. 17, 2016

(65) Prior Publication Data

US 2017/0254135 A1 Sep. 7, 2017

(30) Foreign Application Priority Data

Sep. 11, 2014 (JP) ..... 2014-185205

(51) Int. Cl.
*E05F 15/44* (2015.01)
*E05F 15/689* (2015.01)
*E05F 15/75* (2015.01)

(52) U.S. Cl.
CPC ..... *E05F 15/443* (2015.01); *E05F 15/44* (2015.01); *E05F 15/689* (2015.01); *E05F 15/75* (2015.01);
(Continued)

(58) Field of Classification Search
CPC .... E05F 15/41; E05F 15/443; E05F 2015/447
(Continued)

(56) References Cited

U.S. PATENT DOCUMENTS 4,351,016 A * 9/1982 Felbinger ..... E05F 15/46 318/266
6,515,441 B1 * 2/2003 Tyckowski ..... B60J 7/0573 318/445
(Continued)

FOREIGN PATENT DOCUMENTS

DE 10315188 A1 * 3/2004 ..... E05B 81/76
EP 0791716 A1 * 8/1997
(Continued)

OTHER PUBLICATIONS 10 page machine translation of JP, 2014-043132, A. (Year: 2014).*
(Continued)

*Primary Examiner* — Robert Canfield
(74) *Attorney, Agent, or Firm* — Roberts Mlotkowski Safran Cole & Calderon P.C.

(57) ABSTRACT

A vehicle door glass lifting device includes a lifting and lowering mechanism by which a door glass is lifted or lowered relative to a window frame of a vehicle door, a contact sensor that is arranged on a top end surface of the door glass and extended along a longitudinal direction of the top end surface of the door glass, and a control part that controls the lifting and lowering mechanism. The contact sensor can detect a contact state including a contact length with a contact object. The control part determines whether or not the contact object is a foreign object based on the contact state detected by the contact sensor, and the control part lowers the door glass when the contact object is determined as the foreign object.

8 Claims, 9 Drawing Sheets

(52) U.S. Cl.
CPC ..... *E05Y 2400/32* (2013.01); *E05Y 2900/55* (2013.01)

(58) Field of Classification Search
USPC ..... 49/26–28
See application file for complete search history.

(56) References Cited

U.S. PATENT DOCUMENTS 8,720,279 B2 * 5/2014 Ogawa ..... H03K 17/955 324/658
2002/0047678 A1 * 4/2002 Wilson ..... G05B 19/00 318/445
2002/0190680 A1 * 12/2002 Gerbetz ..... H02H 7/0851 318/445
2007/0113477 A1 * 5/2007 Matsushita ..... E05F 15/46 49/27
2008/0297076 A1 12/2008 Sakai et al.
2009/0314098 A1 * 12/2009 Ogawa ..... H03K 17/955 73/780
2018/0202215 A1 * 7/2018 Katsuyama ..... B60J 1/17

FOREIGN PATENT DOCUMENTS

JP 60071319 A * 4/1985 ..... B60J 1/17
JP 2009-7919 A 1/2009
JP 2014043132 A * 3/2014
JP 2016132864 A * 7/2016 ..... B60J 1/17
JP 6009861 B2 * 10/2016

OTHER PUBLICATIONS 10 page machine translation of EP 0 791 716 A1. (Year: 1997).*
International Search Report issued in the corresponding application No. PCT/JP2015/055649 dated May 26, 2015.
International Preliminary Report on Patentability issued in the corresponding application No. PCT/JP2015/055649 dated Mar. 14, 2017.

* cited by examiner

VEHICLE DOOR GLASS LIFTING DEVICE WITH FOREIGN OBJECTION DETECTION

CROSS-REFERENCE TO RELATED APPLICATIONS

The present application is a U.S. National Phase of PCT/JP 2015/055649 filed on Feb. 26, 2015 claiming priority to Japanese Patent application No. 2014 -185205 filed on Sep. 11, 2014 . The disclosure of the PCT Application is hereby incorporated by reference into the present Application.

TECHNICAL FIELD

The invention relates to a vehicle door glass lifting device which operates to lift and lower a door glass along a window frame of a vehicle door.

BACKGROUND ART

An opening and closing body control device is known which operates to lift or lower a door glass of a vehicle by the driving force of a motor and which has a sufficient countermeasure so as to prevent a driver's or passenger's finger etc. from being nipped (see e.g. PTL1 ).

The opening and closing body control device disclosed in PTL1 operates to move a career plate fixed to the door glass along a guide rail by the driving force of the electric motor. A drum which is rotated by the driving force of the electric motor is arranged at the lower end of the guide rail. The career plate is moved in the vertical direction by a wire wound around the drum.

Also, the opening and closing body control device disclosed in PTL1 operates to detect the nipping of a foreign object on the basis of change of the rotational speed of the electric motor when the door glass is lifted. If the opening and closing body control device detects the nipping of the foreign object, the opening and closing body control device operates to lower the door glass. This kind of opening and closing body control device may have a dead zone where the opening and closing body control device does not detect the nipping of the foreign object near the fully closed position of the door glass so as not to incorrectly detect the contact between the top end part of the door glass and the glass runs etc. as the nipping of the foreign object when closing the door glass completely.

CITATION LIST

Patent Literature

PTL1: JP-A-2009-7919 (paragraphs [0034], [0035], and [0068])

SUMMARY OF INVENTION

Technical Problem

It is preferable to set the dead zone as narrowly as possible because the nipping of the foreign object often occurs just before closing the door glass completely. However, if the dead zone is too narrow, the contact with the glass runs etc. may be incorrectly detected as the nipping of the foreign object because of disturbance such as the vibration of the vehicle and the sliding resistance change of the door glass.

Thus, it is limited to narrow the dead zone and it is hard to set the width of the dead zone to be less than the thickness of the child's finger.

If the device is configured so as to detect a position of the door glass by the rotation number of the motor and so as not to detect the nipping of the foreign object while the detected position is included in the dead zone, the dead zone needs to be set widely in anticipation of a positional shift, which is caused by the possibility that the drum which is made of resin is worn away by the wire and reduced in diameter such that the actual position of the door glass shifts below. Also, the positional shift may be caused by the stretching of the wire across the ages. Thus, in view of these points, it is also limited to narrow the dead zone.

It is an object of an embodiment of the present invention to provide a vehicle door glass lifting device that can certainly detect the nipping of the foreign object near the fully closed position of the door glass by removing the dead zone which has been set so as to prevent the device from detecting incorrectly.

Solution to Problem

According to an embodiment of the invention, a vehicle door glass lifting device comprises:

- a lifting and lowering mechanism by which a door glass is lifted or lowered relative to a window frame of a vehicle door;
- a contact sensor that is arranged on a top end surface of the door glass and extended along a longitudinal direction of the top end surface of the door glass; and
- a control part that controls the lifting and lowering mechanism,
- wherein the contact sensor can detect a contact state including a contact length with a contact object, and
- wherein the control part determines whether or not the contact object is a foreign object based on the contact state detected by the contact sensor, and
- wherein the control part lowers the door glass when the contact object is determined as the foreign object.

Advantageous Effects of Invention

According to an embodiment of the invention, a vehicle door glass lifting device can be provided that can detect certainly the nipping of the foreign object nearby the fully closing position of the door glass by removing the dead zone which has been set so as to prevent the device from error detecting.

DESCRIPTION OF EMBODIMENTS

[Embodiment]

Next, a structure and a movement of a vehicle door glass lifting device according to the present invention will be described below with reference to FIGS. 1 to 8.

Figure 1:
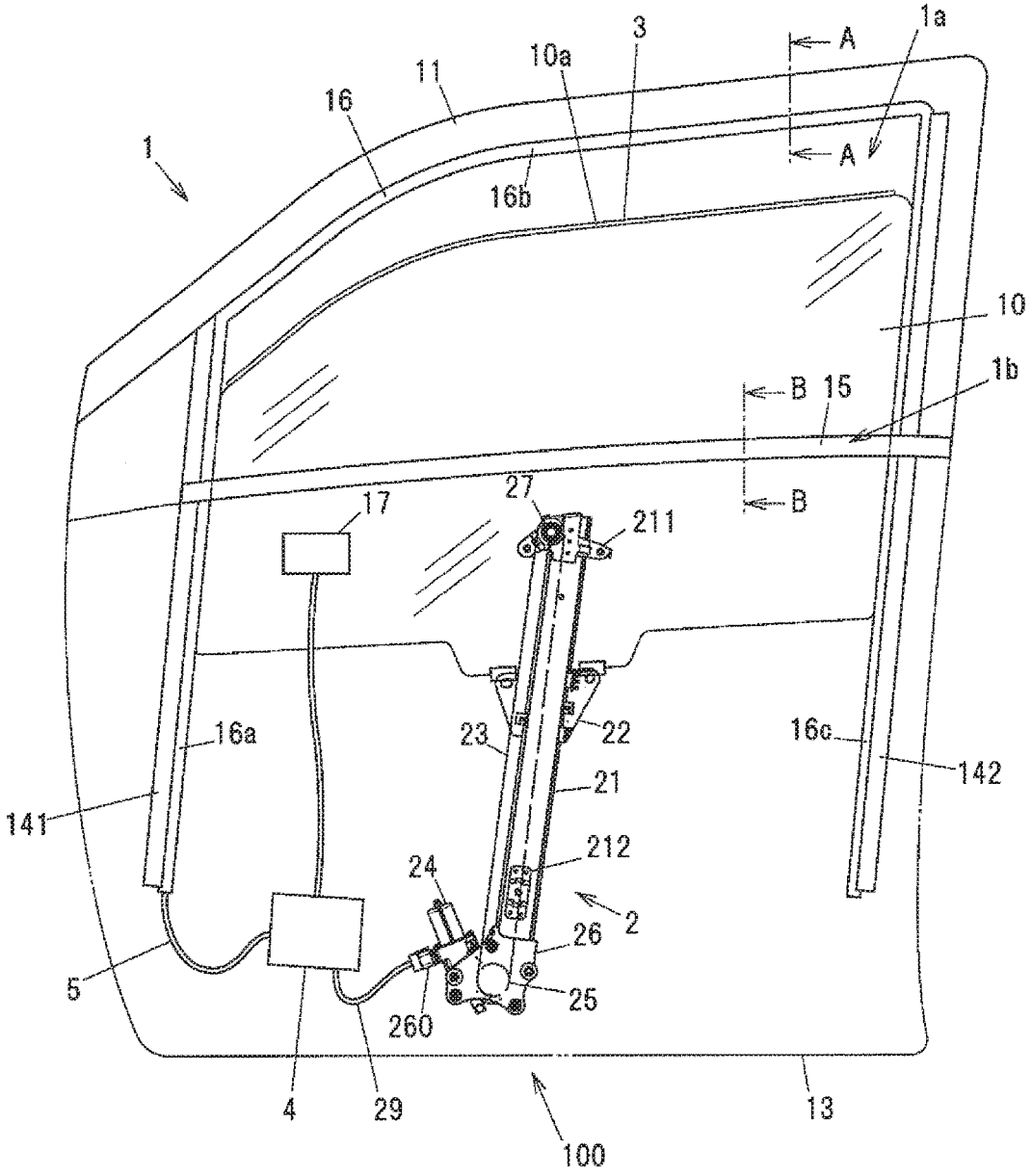
FIG. 1 is an illustration diagram showing a schematic structure of a vehicle door comprising a vehicle door glass lifting device according to the embodiment.

FIG. 1 is an illustration diagram showing a schematic structure of a vehicle door 1 comprising a vehicle door glass lifting device 100 according to the present embodiment.

The door 1 is provided with a window part 1*a*. The window part 1*a* is provided with a door glass 10 so as to be openable and closable. The door 1 is also provided with a door sash 11 as a window frame which defines the window part 1*a* above a belt line 1*b*. A door inner space is defined between an outer panel 13 and an inner panel (not shown) which is opposite to the outer panel 13 below the belt line 1*b*.

The vehicle door glass lifting device 100 is provided with a window regulator 2 as a lifting and lowering mechanism which operates a door glass 10 to lift or lower (open or close) toward the door sash 11, a contact sensor 3 which is arranged at a top end surface 10*a* of the door glass 10 and extends along a longitudinal direction (a vehicle front-back direction) of the top end surface 10*a* of the door glass 10, and a control device 4 which controls the window regulator 2. The window regulator 2 and the control device 4 are received in the door inner space.

The window regulator 2 is provided with a guide rail 21 extending along a moving direction of the door glass 10, a career plate 22 fixed on a bottom end part of the door glass 10, wire 23 fixed on the career plate 22, an electric motor 24 which produces a driving force to lift and lower the door glass 10, a drum 25 rotated by the driving force of the electric motor 24, a housing 26 which receives the drum 25, and a pulley 27 arranged at a top end part of the guide rail 21 as main components.

The guide rail 21 is provided with an upper bracket 211 and a lower bracket 212 as fixed parts fixed on the inner panel. The pulley 27 is rotatably supported by the upper bracket 21.

Figure 2A:
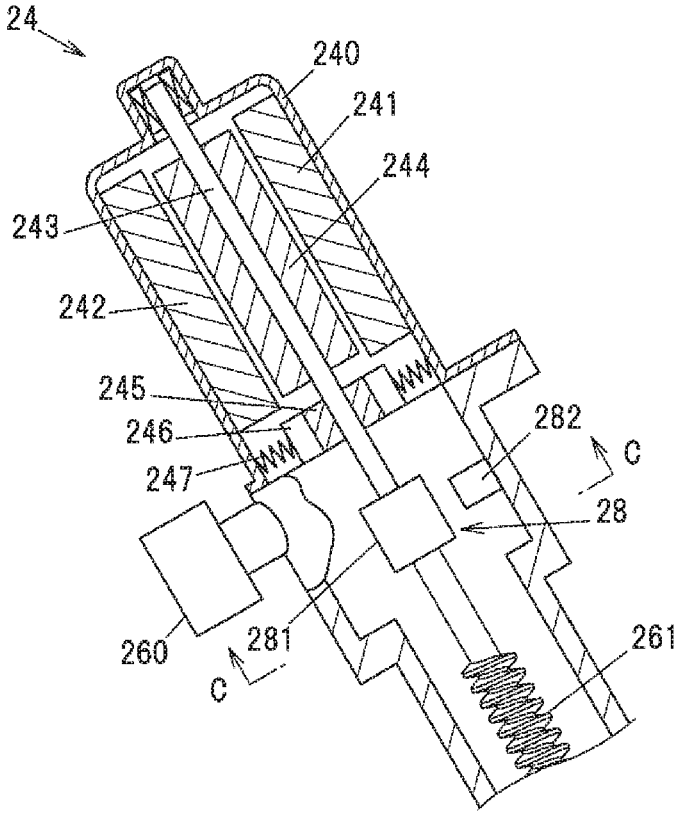
FIG. 2A is a partial cross sectional view showing an electric motor and a housing.
Figure 2B:
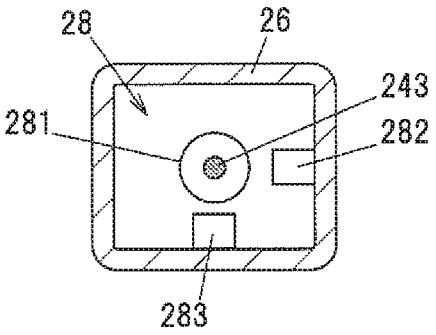
FIG. 2B is a cross sectional view showing a housing cut along the line C-C in FIG. 2A.

FIG. 2A is a cross sectional view showing the electric motor 24 and the housing 26 which are cut partly along a rotational axis of the electric motor 24. FIG. 2B is a cross sectional view showing the housing 26 cut along the line C-C in FIG. 2A.

The electric motor 24 is a DC motor having a brush. The electric motor 24 produces the driving force to lift and lower the door glass 10 by receiving motor current supplied from the control device 4 through a cable 29 connected to a connector 260 of the housing 26 (shown in FIG. 1).

The electric motor 24 is provided with a yoke 240, one pair of permanent magnets 241, 242 fixed on an inner surface of the yoke 240, a shaft 243 rotatably supported by the yoke 240, an armature 244 and a commutator 245 arranged so as to rotate integrally with the shaft 243, a brush 246 which slides with the commutator 245 along with the rotation of the shaft 243, and a spring 247 which presses the brush 246 on the commutator 245. The brush 246 is electrically connected to a terminal (not shown) of the connector 260.

And the shaft 243 is arranged such that a disk-shaped magnetic rotor 291 rotates integrally. One pair of Hall elements 282, 283 which are fixed on the housing 26 are opposite to an outer peripheral surface of the magnetic rotor 281. The magnetic rotor 281 comprises one pair of magnetic poles (the N-pole and the S-pole). And magnetic field direction detected from the Hall elements 282, 283 is changed by rotating the magnetic rotor 281. A detecting signal of the Hall elements 282, 283 is a pulse-like signal. The magnetic rotor 281 and the Hall elements 282, 283 configure a pulse generator 28 which generates a pulse signal at a frequency along the rotational speed of the shaft 243.

The detected signal of the Hall elements 282, 283 (the output signal from the pulse generator 28) is output to the control device 4 through the cable 29. Positions between the Hall elements 282, 283 in the rotational direction of the magnetic rotor 281 are different in 90°. Thus, phases of the detected signals of the Hall elements 282, 283 are different in 90°. The control device 4 can detect the rotational direction of the electric motor 24 by the difference between the phases.

Also, a worm gear mechanism comprising a worm 261 arranged on an output axis of the electric motor 24, and a worm gear (not shown) which rotates integrally with the drum 25 is received in the housing 26. When the electric motor 24 rotates, the rotational force is transmitted to the drum 25 while the rotational speed is reduced by the worm gear mechanism.

As shown in FIG. 1, the wire 23 is wound around the drum 25 and the pulley 27, and top and bottom of the wire 23 are fixed on the career plate 22. The wire 23 is multiply wound on the drum 25 along a spiral groove formed on an outer peripheral surface of the drum 25. The career plate 22 is guided with the guide rail 21 and lifted with the door glass 10 while the electric motor 24 rotates normally and the drum 25 rotates toward one direction by the driving force of the electric motor 24. And the career plate 22 is guided with the guide rail 21 and lowered with the door glass 10 while the electric motor 24 rotates reversely. The control device 4 can detect a position of the door glass 10 by counting a number of the pulse of the detecting signal output from the Hall elements 282, 283.

The door glass 10 is operated to be opened and closed in the vertical direction along glass guides 141, 142 arranged at the door 1 and the top end surface 10*a* of the door glass 10 is located in a position lower than a weather strip 15 arranged along the belt line 1*b* while the door glass 10 is fully opened. Also, a glass run channel (hereinafter referred to as "glass run") made of an elastic body such as rubber is fitted in a concaved groove formed on the glass guides 141, 142 and an top part of the door sash 11.

The glass run 16 is arranged at a way from a bottom end of the vehicle front side glass guide 141 to a bottom end of the vehicle rear side glass guide 142 thorough the top part of the door sash 11, and is integrally formed with a front glass run 16*a* arranged on the vehicle front side glass guide 141, an upper glass run 16*b* arranged on the top part of the door sash 11, and a front glass run 16*a* arranged on the vehicle rear side glass guide 142. The front glass run 16*a* supports a vehicle front side end of the door glass 10 slidably and the rear glass run 16*c* supports a vehicle rear side end of the door glass 10 slidably. Also, the contact sensor 3 contacts on the upper glass run 16*b* while the door glass 10 opens fully.

The control device 4 opens and closes the door glass 10 by controlling the electric motor 24 of the window regulator 2 corresponding to a switch operation of a switch 17 arranged at a car room side of the door 1. And the control device 4 is connected to the contact sensor 3 thorough the cable 5 and can detect the contact with a contact object while the operation of the opening and closing of the door glass 10. The contact object includes the foreign object such as the driver's or a passenger's finger in addition to the weather strip 15 or the glass run 16. The control device 4 lowers the door glass 10 so as to prevent the foreign object from being nipped while the contact sensor 3 detects the contact with the foreign object.

The contact sensor 3 is fixed on the top end surface 10*a* of the door glass 10 by adhesion and is configured and arranged such that an end of the contact sensor 3 in the extending direction fails to detect the contact with the glass run 16 (the front glass run 16*a* and the rear glass run 16*c*) which is fit in the glass guides 141, 142.

Figure 3:
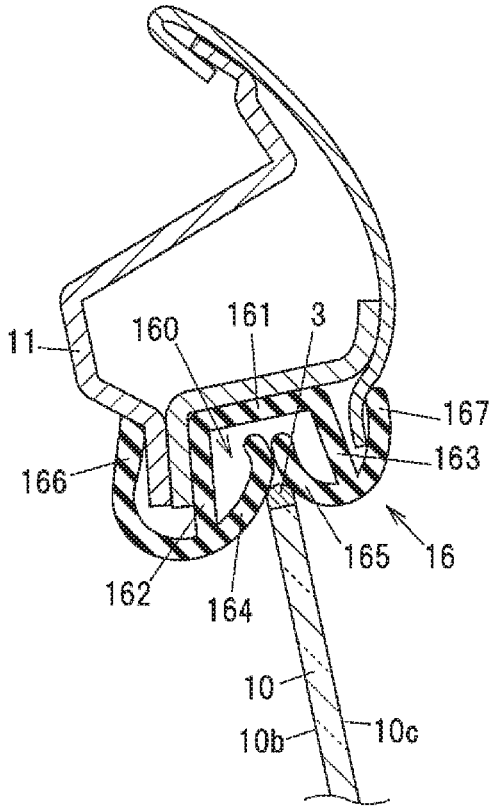
FIG. 3 is a cross sectional view cut along the line A-A in FIG. 1.

FIG. 3 is a cross sectional view along the line A-A of FIG. 1. The glass run 16 is provided with a receiving space 160 to receive the end of the door glass 10, which is made by extrusion molding of ethylene propylene diene monomer (EPDM) rubber. The glass run 16 is integrally provided with a bottom wall 161 formed at inner of the receiving space 160, a vehicle interior sidewall 162 extended from a vehicle interior side end of the bottom wall 161 toward the window part 1*a*, a vehicle exterior sidewall 163 extended from an vehicle exterior side end of the bottom wall 161 toward the window part 1*a*, a vehicle interior side seal lip 164 projected from the vehicle interior sidewall 162 toward the receiving space 160, a vehicle exterior side seal lip 165 projected from the vehicle exterior sidewall 163 toward the receiving space 160, a vehicle interior side cover lip 166 projected from the vehicle interior sidewall 162 toward the opposite side to the receiving space 160, and a vehicle exterior side cover lip 167 projected from the vehicle exterior sidewall 163 toward the opposite side to the receiving space 160.

The receiving space 160 is defined by the bottom wall 161, the vehicle interior sidewall 162, and the vehicle exterior sidewall 163. The bottom wall 161 is arranged at the top end part of the receiving space 160 in the upper glass run 16*b*. The vehicle interior side seal lip 164 contacts slidably with an inner surface 10*b* of the door glass 10 in the receiving space 160 and the vehicle exterior side seal lip 165 contacts slidably with an outer surface 10*c* of the door glass 10 in the receiving space 160.

The contact sensor 3 which is arranged at the top end surface 10*a* of the door glass 10 is pushed on and contacts the bottom wall 161 of the upper glass run 16*b*. The bottom walls 161 of the front glass run 16*a* and the rear glass run 16*c* are opposite to a front end surface and a rear end surface of the door glass 10. However, a space between the bottom wall 161 of the front glass run 16*a* and the bottom wall 161 of the rear glass run 16*c* are formed longer than the length of the door glass 10 in the vehicle front-rear direction such that the door glass 10 is slidably supported. Thus, the door glass 10 is inclined barely in being lifted and lowered for the vehicle front side or the vehicle rear side. For example, an inclined angle of the door glass 10 to the horizontal direction in being lifted and lowered is 0.2° to 0.5°.

Figure 4:
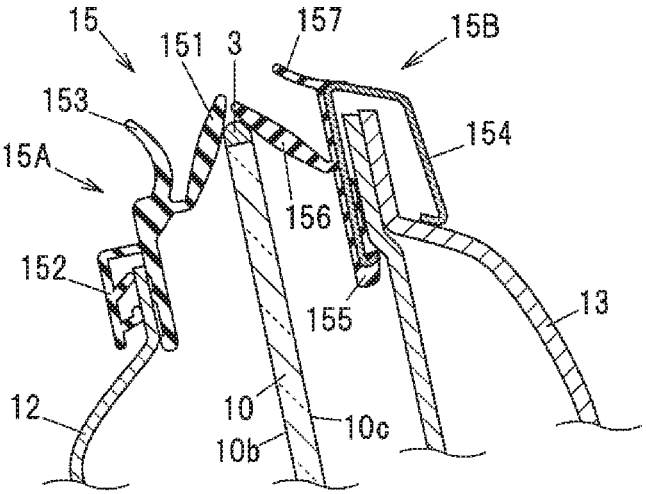
FIG. 4 is a cross sectional view cut along the line B-B in FIG. 1.

FIG. 4 is a cross sectional view along the line B-B of FIG. 1. The weather strip 15 is configured by an inner member 15A which is fixed at top end part of the inner panel 12 in the belt line 1*b* and an outer member 15B which is fixed at top end part of the outer panel 13 in the belt line 1*b*. The inner member 15A is integrally provided with a vehicle interior side seal lip 151 which contacts slidably on the inner surface 10*b* of the door glass 10, a fitting part 152 which is fit and fixed at the end of the inner panel 12, and a fin 153 projected from the fitting part 152 toward upper. The outer member 15B is provided with a core member 154 which is fixed at the end of the outer panel 13, a jointing part 155 which is jointed to the core member 154, a vehicle interior side seal lip 151 which projects from the jointing part 155 toward the vehicle interior side and contacts slidably on the outer surface 10*c* of the door glass 10, and a fin 157 formed at upper of the vehicle exterior side seal lip 156.

The core member 154 is made of a metal such as iron or stainless, or resin. The vehicle interior side seal lip 151, the fitting part 152, the fin 153, the jointing part 155, the vehicle exterior side seal lip 156, and the fin 157 are made of the rubber such as EPDM.

While the door glass 10 shifts from the fully opening state to the fully closing state, firstly, the contact sensor 3 contacts the vehicle interior side seal lip 151 and the vehicle exterior side seal lip 156 of the weather strip 15, and then contacts the vehicle interior side seal lip 164 and the vehicle exterior side seal lip 165 of the glass run 16. And if the foreign body contacts the contact sensor 3 while the door glass 10 shifts from the fully opening state to the fully closing state, the control device 4 lowers the door glass 10 so as to prevent the foreign object from being nipped. Next, the configuration of the contact sensor 3 will be described below with reference to FIGS. 5A to 5D.

(Configuration of the Contact Sensor 3)

Figure 5A:
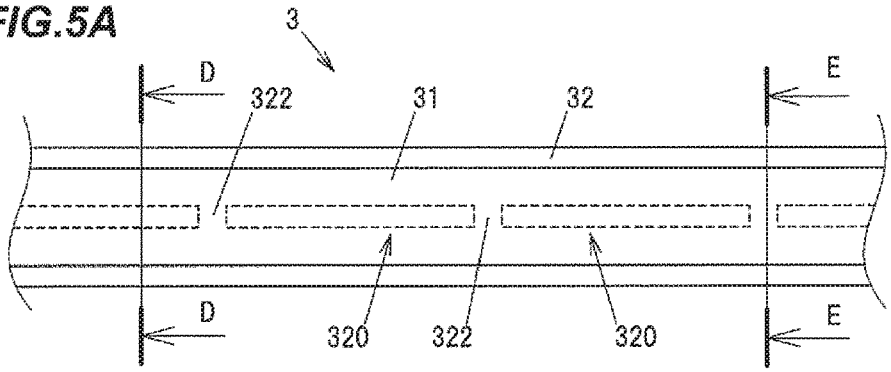
FIG. 5A is a front view showing a contact sensor.
Figure 5B:
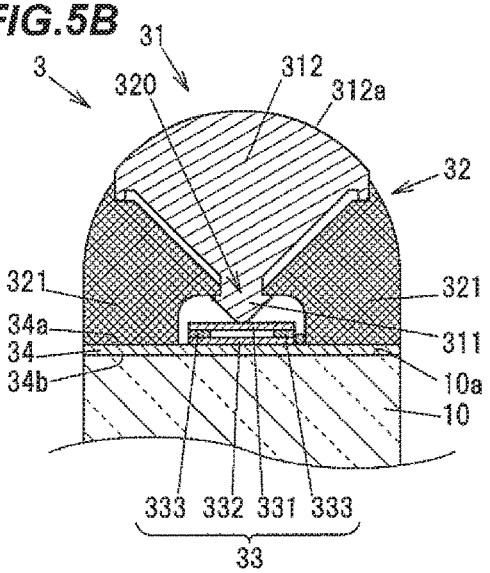
FIG. 5B is a cross sectional view cut along the line D-D in FIG. 5A.
Figure 5C:
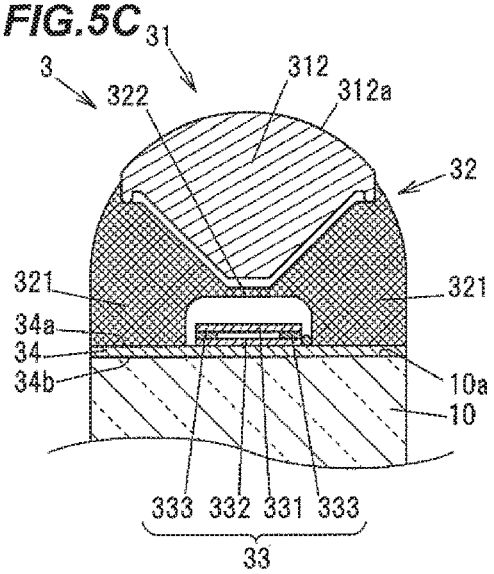
FIG. 5C is a cross sectional view cut along the line E-E in FIG. 5A.
Figure 5D:
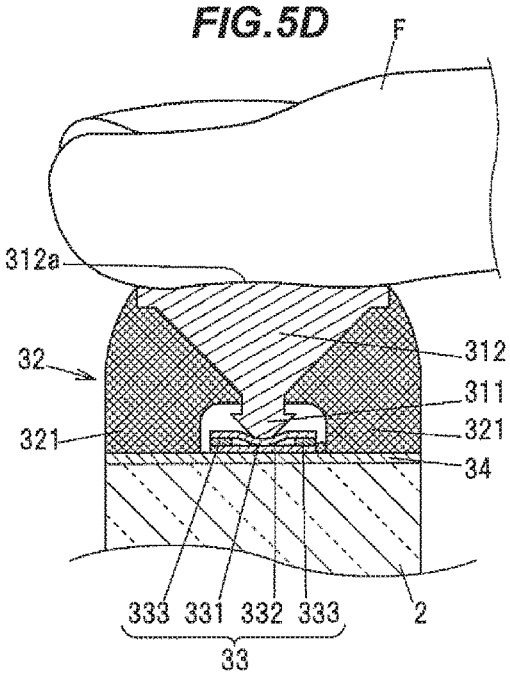
FIG. 5D is a cross sectional view showing a contact state with a foreign object.

FIG. 5A is a front view showing a part of the contact sensor 3 arranged at the top end surface 10*a* of the door glass 10 in the longitudinal direction viewed from upper orthogonal to the top end surface 10*a*. FIG. 5B is a cross sectional view cut along the line D-D in FIG. 5A. FIG. 5C is a cross sectional view cut along the line E-E in FIG. 5A. FIG. 5D is a cross sectional view showing a contact state which a finger F as the foreign object contacts the contact sensor 3 cut along the line D-D in FIG. 5A.

The contact sensor 3 is provided with a contact member 31 which is elastically deformed by contacting with a contact object, a holding member 32 which holds the contact member 31, a contact detecting portion 33 which outputs an electric signal which means the contact with the contact object, and a plate-shaped mounting member 34 which is interposed between the holding member 32 and the contact detecting portion 33, and the top end surface 10*a* of the door glass 10.

The contact member 31 is made of flexible material such as rubber, and is elastically deformed by contacting with the contact object. The holding member 32 is made of a material whose elastic modulus is more than an elastic modulus of the contact member 31, which can use substantially, for example, polycarbonite, acryl, or polyacetal. Herein, the elastic modulus is a value dividing stress by strain within an elastic limit. And the elastic modulus means that the higher elastic modulus, a harder and hardly deformable material.

The holding member 32 is fixed on the door glass 10 through the mounting member 34. The holding member 32 and the contact detecting portion 33 are bonded on the upper surface 34*a* of the mounting member 34 and the lower surface 34*b* is bonded on the top end surface 10*a* of the door glass 10.

Also, the holding member 32 is provided with one pair of wall parts 321 which sandwich the contact member 31 in a width direction of the door glass 10 (a vehicle width direction), and a plurality of window parts 320 which are made between the one pair of wall parts 321 and in which a part of the contact member 31 is inserted. Each of the window parts 320 is a slot extending along the longitudinal direction of the contact sensor 3 in the top view shown in FIG. 5A and defined by a beam portion 322 which is integrally made with the wall part 321. FIG. 5A shows an edge of the window part 320 by dashed-line.

The contact detecting portion 33 is provided with a first conductive member 331 arranged along the longitudinal direction of the top end surface 10*a* of the door glass 10, a second conductive member 332 which is arranged in parallel to the first conductive member 331 and whose resistance per unit length is more than a resistance per unit length of the first conductive member 331, one pair of separating members 333 which separate contactably and separatably between the first conductive member 331 and the second conductive member 332. The first conductive member 331 and the second conductive member 332 contact each other at a contact position between the contact member 31 and the contact object by being pressed by the contact member 31.

The second conductive member 332 is an electric resistance having a specified resistivity, for example, which is made of conductive rubber and is fixed on the upper surface 34*a* of the mounting member 34 by using fixing means such as adhesion. For example, the mounting member 34 is made of the resin material as with the holding member 32. For example, the first conductive member 331 is made of a good conductive metal such as Aluminum or Copper and arranged in parallel to the second conductive member 332.

The contact member 31 is provided with a pressing portion 311 which is inserted through the window part 320 formed in the holding member 32 and presses the contact detecting portion 33, and a contacting portion 312 which contacts the contact object at an opposite side to the contact detecting portion 33 from the window part 320 (the upper side from the window part 320). Then, as shown in FIG. 5D, when the contact object (the finger F) contacts on an upper surface 312*a* of the contacting portion 312 and the contacting portion 312 is downwardly pushed and elastically deformed by the pressure caused by the contact, the pressing portion 311 is downwardly pushed from the window part 320 and downwardly presses the first conductive member 331 of the contact detecting portion 33. The first conductive member 331 contacts the second conductive member 332.

Figure 6:
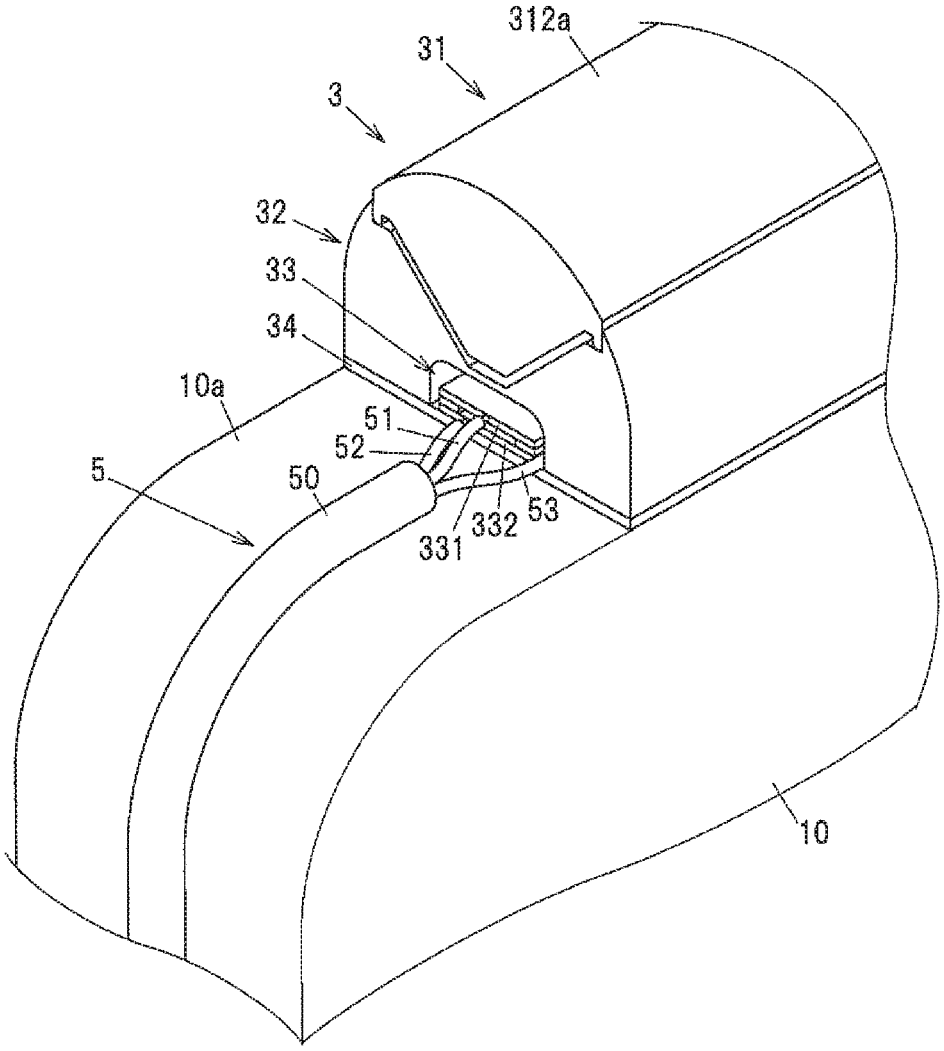
FIG. 6 is a perspective view showing a connecting state between the contact sensor and a cable at a front side end of the door glass.

FIG. 6 is a perspective view showing a connecting state between the contact sensor 3 and a cable 5 at a front side end of the door glass 10. FIGS. 7A to 7D is an illustration diagram schematically showing a configuration of the contact detecting portion 33 of the contact sensor 3.

The control device 4 and the contact sensor 3 are connected with first to third electric wires 51 to 53 of the cable 5. As shown in FIG. 6, the first to third electric wires 51 to 53 are covered with a sheath 50. The sheath 50 and the first to third electric wires 51 to 53 configure the cable 5. The first to third electric wires 51 to 53 are insulated electric wires which cover a core wire made of a conductive wire such as Copper with an insulator made of, for example, resin and rubber. Meanwhile, it is not shown, an end of the contact sensor 3 is sealed with silicone resin and so on, and prevents water and so on from entering into the contact detecting portion 33 or a space between the contact member 31 and the holding member 32.

As shown in FIGS. 7A to 7D, the control device 4 is provided with a central processing unit (CPU) 40 which performs a process based on a preliminary memorized program, a direct current power source 41, an ampere meter 42 which measures output current from the direct current power source 41, first and second switching elements 43, 44, and current output part 45 to supply motor current to the electric motor 24.

The CPU 40 can detect the output current from the direct current power source 41 by receiving a detecting signal from the ampere meter 42. And the CPU 40 can receive the detecting signals from the Hall elements 282, 283 through the cable 29. Furthermore, the CPU 40 can output control signal for the current output part 45 such that the electric motor 24 rotates normally or reversely. That is, the CPU 40 functions as a control part which controls the window regulator 2.

The first and second switching elements 43, 44 are turned on/off by the CPU 40. Meanwhile, although the first and second switching elements 43, 44 are configured from transistors, an element such as Field Effect Transistor (FET) or solid state relay can be used.

In the below explanation, a state which can supply the current to the first and second switching elements 43, 44 is referred to as an ON state, and a state which the first and second switching elements 43, 44 shuts the current is referred to as an OFF state. The CPU 40 controls the first and second switching element 43, 44 such that as one of the switching elements is in the ON state, the other switching element is in the OFF state.

The first electric wire 51 connects electrically the first switching element 43 in the control device 4 and one end of the first conductive member 331 in the contact sensor 3. The second electric wire 52 connects electrically an output side of the ampere meter 42 in the control device 4 and one end of the second conductive member 332 in the contact sensor 3. The third electric wire 53 connects electrically the second switching element 44 in the control device 4 and the other end of the second conductive member 332 in the contact sensor 3. Furthermore, the other end of the first conductive member 331 in the contact sensor 3 is an open end. Thus, the other end of the first conductive member 331 is not electrically connected to any member.

In the below explanation, one end of the second conductive member 332 which is connected to the second electric wire 52 is referred to as the point A, one end of the first conductive member 331 which is connected to the first electric wire 51 is referred to as the point B, and the other end of the second conductive member 332 which is connected to the third electric wire 53 is referred to as the point C.

Figure 7A:
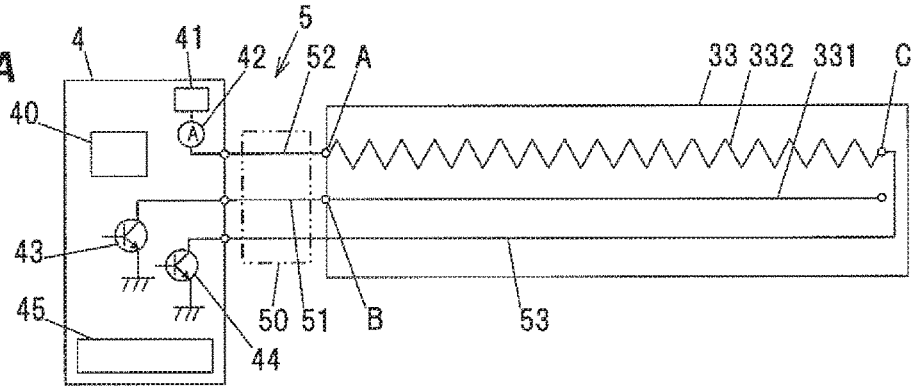
FIG. 7A is an illustration diagram showing a structure and a movement of a contact detecting portion of a control device and the contact sensor.
Figure 7B:
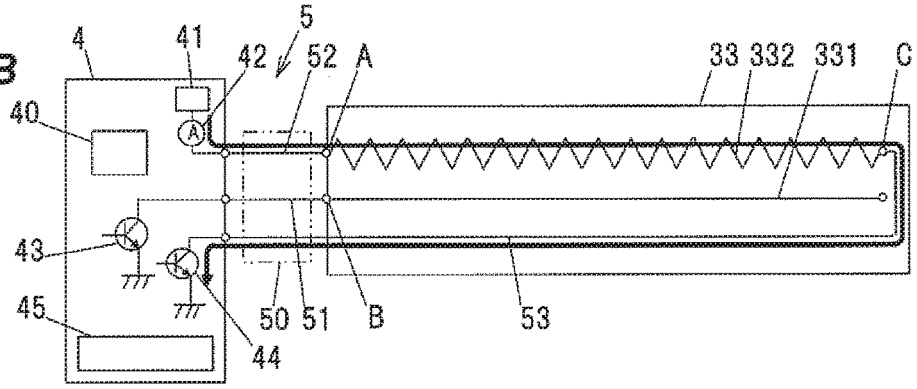
FIG. 7B is an illustration diagram showing the structure and the movement of the contact detecting portion of the control device and the contact sensor.

FIG. 7A shows non energizing state that the current is not output from the direct current power source 41. FIG. 7B shows a current path in the state that the direct current power source 41 outputs the current and the second switching element 44 is in the ON state, and the contact object fails to contact with the contact sensor 3 represented by using the bold line. In the state shown in FIG. 7B, the output current from the direct current power source 41 flows along the second conductive member 332 from the point A to the point C and the ampere meter 42 detects a current value by dividing the power voltage of the direct current power source 41 by the whole resistance of the second conductive member 332.

Figure 7C:
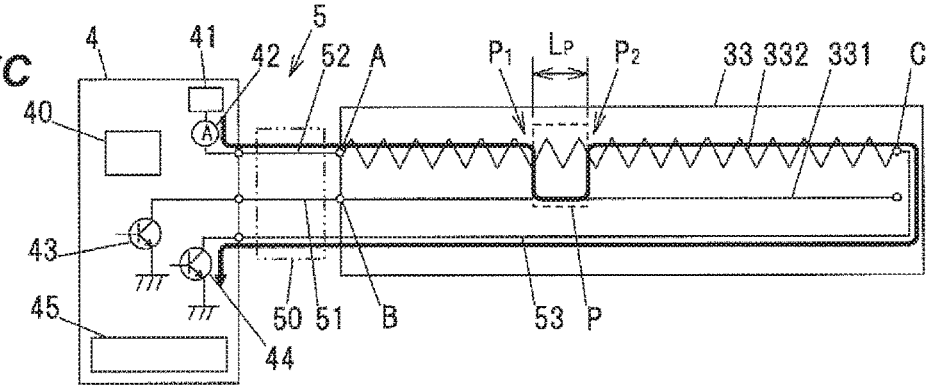
FIG. 7C is an illustration diagram showing the structure and the movement of the contact detecting portion of the control device and the contact sensor.

FIG. 7C shows a state that the contact object contacts with the contact sensor 3 at the contact place P in the state shown in FIG. 7B and a current path output from the direct current power source 41 in the state represented by using the bold line. The first conductive member 331 and the second conductive member 332 are contacted at the contact place P by being pressed by the pressing portion 311 of the contact member 31. Thus, the output current from the direct current power source 41 flows the first conductive member 331 whose resistance is low. Hereby, the resistance in the current path from the point A to the point C is reduced, thus the current value which is detected in the ampere meter 42 is increased. The CPU 40 in the control device 4 can detect that the contact object contacts the contact sensor 3 by the current change.

The resistance per unit length in the longitudinal direction of the whole of second conductive member 332 is constant in the whole of the second conductive member 332 from the point A to the point C. Thus, the CPU 40 can calculate the contact length between the first conductive member 331 and the second conductive member 332 by calculating the resistance between the point A and the point C by an operation based on the detected value in the ampere meter 42. That is, the CPU 40 can detect the contact length $L_P$ at the contact place P between the contact object and the contact sensor 3 on the basis of the electrical resistance between the both ends of the second conductive member 332 in the longitudinal direction.

If the door glass 10 is in the closed state and the contact sensor 3 contacts the upper glass run 16*b* (the vehicle interior side seal lip 164 and/or the vehicle exterior side seal lip 165) along the whole of the contact sensor 3 in the longitudinal direction, the contact length $L_P$ is equal to the whole length of the second conductive member 332 and the resistance between the point A and the point C is substantially zero. Meanwhile, if the contact object is, for example, the driver's finger, the electrical resistance between the point A and the point C becomes, for example, 90 to 99% of the electric resistance between the both ends of the second conductive member 332, which is different from the closing state of the door glass 10. Thus, the CPU 40 can determine whether the contact object is the foreign object or not under at least a condition that the contact length $L_P$ with the contact object detected by the contact sensor 3 is less than the specified value. Furthermore, the electrical resistance between the both ends of the second conductive member 332 means an electrical resistance between the both ends (between the point A and the point C) of the stand-alone second conductive member 332 in the longitudinal direction which fails to have any contact with the first conductive member 331.

Figure 7D:
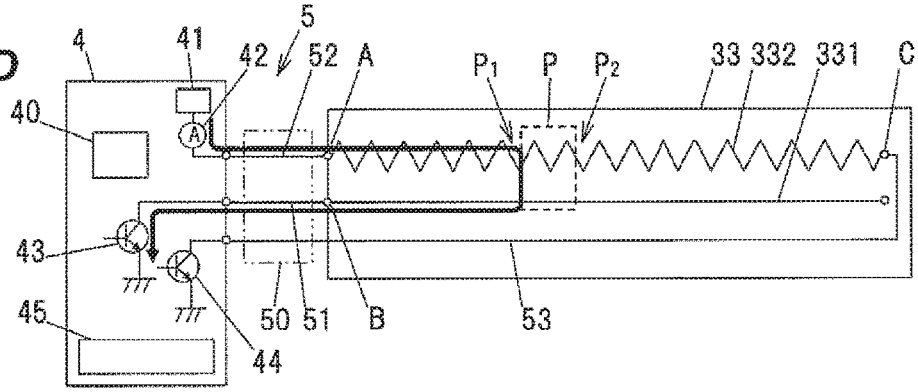
FIG. 7D is an illustration diagram showing the structure and the movement of the contact detecting portion of the control device and the contact sensor.

Also, the CPU 40 in the control device 4 can detect the contact position with the contact object by switching the second switching element 44 to the OFF state and the first switching element 43 to the ON state and changing the current path of the output current from the direct current power source 41 when the contact object contacts with the contact sensor 3. FIG. 7D shows the current path in the state by using the bold line.

According to the changing of the ON/OFF state of the first and second switching elements 43, 44, the output current from the direct current power source 41 reflects at one end $P_1$ (the point A side end and the point B side end) of the contact place P and flows forward the first switching element 43 through the point B and the first electric wire 51.

The CPU 40 in the control device 4 can calculate the distance from the point A to the one end $P_1$ of the contact place P, that is, the one end $P_1$ which is a origin of the contact place P by calculating the resistance between the point A and the point B based on the detected value in the ampere meter 42 in the state shown in FIG. 7D. Furthermore, the CPU 40 can also calculate the position of the other end $P_2$ (the point C side end) which is the end point of the contact place P by considering the position of the one end $P_1$ of the contact place P with the contact length $L_P$ in the contact place P.

Thus, the CPU 40 can also determine whether the contact object is the foreign object or not by considering the positions of the one end $P_1$ and the other end $P_2$ of the contact place P in addition to the contact length $L_P$ with the contact object. Specifically, for example, the CPU 40 determines whether the contact object is the weather strip 15 or not on the basis of the positions of the one end $P_1$ and the other end $P_2$ of the contact place P. If the contact object is determined as the weather strip 15, not the foreign object, the door glass 10 can continues to be lifted.

Hereby, the contact sensor 3 can detect the contact state within the contact length with the contact object. The CPU 40 determines whether the contact object is the foreign object or not on the basis of the contact state detected by the contact sensor 3. If the contact object is determined as the foreign object, the door glass 10 is lowered. Next, an example of the process that the CPU 40 performs will be described above in conjunction with FIG. 8.

Figure 8:
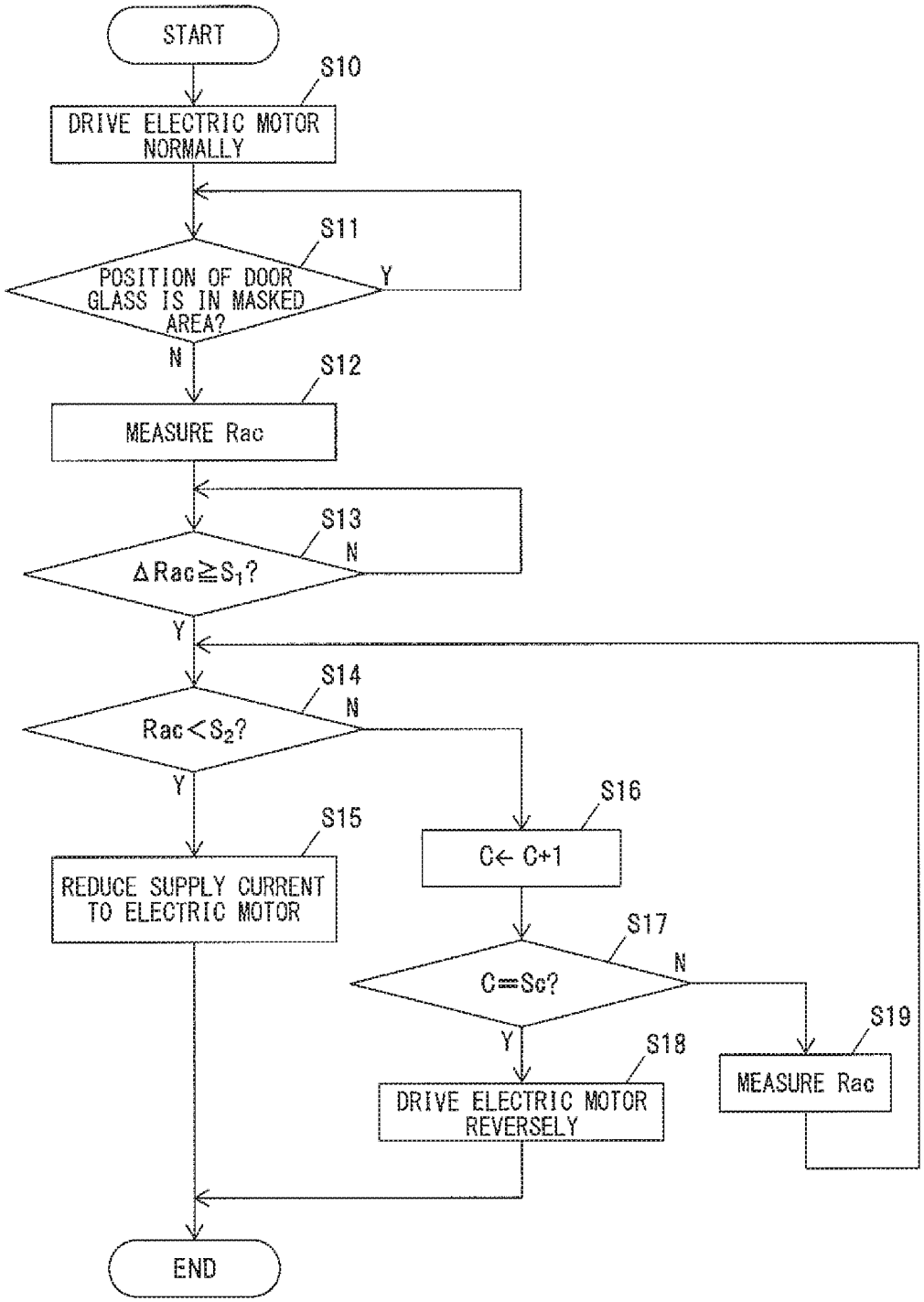
FIG. 8 is a flowchart showing an example of a process performed by a CPU as a control part.

FIG. 8 is a flowchart showing an example of a process that the CPU 40 in the control device 4 performs when movement of the door glass 10 for the closing direction (lifting) by operating the switch 17 is commanded. In the flowchart, the CPU 40 determines whether the contact object is the foreign object or not on the basis of a resistance between the both ends of the second conductive member 332 (between the point A and the point C) which corresponds to the contact length $L_P$ at the contact place P between the contact sensor 3 and the contact object (hereinafter the resistance is referred to as "Rac").

The CPU 40 samples the detecting signal in the ampere meter 42 at every 0.5 ms and calculates the Rac. Also, the CPU 40 counts the pulse signal in interrupt process, for example, which is produced in raising the pulse signal from the Hall elements 282, 283 and detects the position of the door glass 10 constantly.

The CPU 40 outputs a command signal to the current output part 45 and begins to drive normally the electric motor 24 when the closing operation of the door glass 10 is commanded by operating the switch 17 by, for example, the driver (the step S10). The current output part 45 supplies the motor current to the electric motor 24 and the door glass 10 is lifted after the process.

Next, the CPU 40 determines whether the position of the door glass 10 is within a specified masked area or not (the step S11). The masked area is set so as to prevent the door glass 10 from being lowered while the CPU 40 determines that the weather strip 15 is the foreign object if the contact sensor 3 contacts the weather strip 15 (the vehicle interior side seal lip 151 and/or the vehicle exterior side seal lip 156). The upper limit and bottom limit of the masked area is set corresponding to a range of the position of the door glass 10 in which the contact member 31 of the contact sensor 3 may contacts the weather strip 15. The CPU 40 fails to perform the nipping determination process after the step S12 when the position of the door glass 10 is included within the masked area.

Meanwhile, the CPU 40 may determine whether the contact object is the weather strip 15 or not on the basis of the positions of the one end $P_1$ and the other end $P_2$ of the contact place P instead of the determination whether the door glass 10 is included in the masked area or not, and may stop performing the nipping determination process after the step S12 while the contact sensor 3 contacts the weather strip 15.

The CPU 40 samples the detecting signal from the ampere meter 42 at every specified sampling period (0.5 ms) and measures the Rac (the step S12) after the door glass 10 is lifted and escapes from the masked area (the step S11: No) and determines whether ΔRac which is a difference between the Rac and the Rac in the last period is not less than the specified value $S_1$ or not (the step S13). The specified value $S_1$ is set at a small value which is, for example, not more than 0.5% of the resistance between the both ends of the second conductive member 332 so as to avoid an effect caused by an error in the detecting signal of the ampere meter 42 etc. The CPU 40 repeats the step S12 again if the ΔRac is less than the specified value $S_1$.

Meanwhile, if the ΔRac is not less than the specified value $S_1$ (S13: YES), that is, the Rac is significantly changed and the contact between the contact sensor 3 and the contact object is detected, the CPU 40 determines whether the contact object is the foreign object or not on the basis of a plurality of the detections of the Rac (10 times in the present embodiment) after the detection of the contact between the contact sensor 3 and the contact object.

Accordingly, the CPU 40 determines whether the Rac is substantially Zero or not, specifically, whether the Rac is less than a specified value $S_2$ considering a measuring error, which is close to zero or not (the step 14). The CPU 40 determines that the contact sensor 3 contacts the seal lip of the upper glass run 16*b* (the vehicle interior side seal lip 164 and/or the vehicle exterior side seal lip 165) and reduce the supply current to the electric motor 24 (the step S15) if the Rac is substantially zero (S14: YES).

The supply current reducing process in the step 15 may stop completely the supply current to the electric motor 24, or may reduce gradually the supply current to the electric motor 24 if the process can control the supply current gradually or stably. Even if the supply current to the electric motor 24 is completely stopped, the door glass 10 continues to be lifted caused by the inertia and is stopped by contacting the contact sensor 3 with the bottom wall 161 of the upper glass run 16*b*.

Meanwhile, if the Rac is not substantially zero in the determination in the step S14 (S14: No), the CPU 40 increments a counter C (the step S16) and determines whether the counter C is a specified number Sc or not (Sc=10 in the present embodiment) (the step S17). Furthermore, the counter C is reset to zero previously before the electric motor 24 begins to drive normally.

If the counter C is the specified number Sc in the process in the step S17 (S17: Yes), the CPU 40 determines that the contact object which contacts the contact sensor 3 is the foreign object. Then the electric motor 24 is reversely driven (the step S18) and the door glass 10 is lowered. Specifically, the CPU 40 outputs the command signal to the current output part 45 and supplies the motor current which is reversed from the normal drive to the electric motor 24. Meanwhile, the CPU 40 may lower the door glass 10 to a lowering end position in the process in the step 18, or may lower the door glass 10 by specified length (for example, 150 mm) or specified time (for example, 1 second). Hereby nipping of the foreign object can be prevented.

Meanwhile, if the counter C is less than the specified number (Sc) (S17: No), the CPU 40 measures the Rac (the step S19) and repeat the process after the step S14 again.

According to the above process, if the Rac is specifically zero after detecting that the contact object contacts the contact sensor 3 during a specified period (0.5 ms×10=5 ms in the present embodiment) corresponding to the specified number Sc by the process in the step S13, the CPU 40 determines that the contact object is the seal lip of the glass run 16 (the upper glass run 16*b*) and reduce the supply current to the electric motor 24. The determination process using the specified number Sc considers that the whole of the contact sensor 3 in the lengthwise direction may or may not substantially contact the glass run 16, for example, when the door glass 10 is lifted while the door glass 10 is inclined with respect to the horizontal direction.

Meanwhile, if the contact object is the foreign object such as the finger, the Rac fails to be substantially zero during the specified period corresponding to the specified number Sc. Thus, the contact object is determined as the foreign object after the specified period is passed, and the door glass 10 is lowered. That is, the contact object is determined whether the contact object is the foreign object or not under the condition which the Rac is not less than the specified number $S_2$, that is to say, the contact length $L_P$ with the contact object is not more than the specified value.

According to the first embodiment described above, the nipping of the foreign object nearby the completely closing position of the door glass 10 can be detected certainly without the dead zone so as to prevent detecting falsely because the contact sensor 3 can detect the contact with the foreign object until the contact sensor 3 contacts the glass run 16. Moreover, the CPU 40 can determines correctly whether the contact object is the foreign object or not because the contact object is determined whether the foreign object or not under the condition that the contact length $L_P$ with the contact object detected by the contact sensor 3 is not more than the specified value. Furthermore, if the CPU 40 detects the contact between the contact sensor 3 and the contact object, the CPU 40 can determine more correctly whether the contact object is the foreign object or not because the CPU 40 determines whether the contact object is the foreign object or not on the basis of the plurality of detection results of the Rac after the detection of the contact between the contact sensor 3 and the contact object.

Furthermore, the CPU 40 reduces the supply current to the electric motor 24 if the CPU 40 determines that the contact object is the seal lip of the glass run 16 (the vehicle interior side seal lip 164 and/or the vehicle exterior side seal lip 165). Thus, the door glass 10 is decelerated when the contact sensor 3 contacts the bottom wall 161 of the glass run 16. Hereby, an impact which the contact sensor 3 receives can be reduced and a vibration and an impact noise occurred in the door 1 can be reduced comparing with the case that the specified motor current is supplied to the electric motor 24 until the contact sensor 3 contacts the bottom wall 161 of the glass run 16.

[Second Embodiment]

Figure 9:
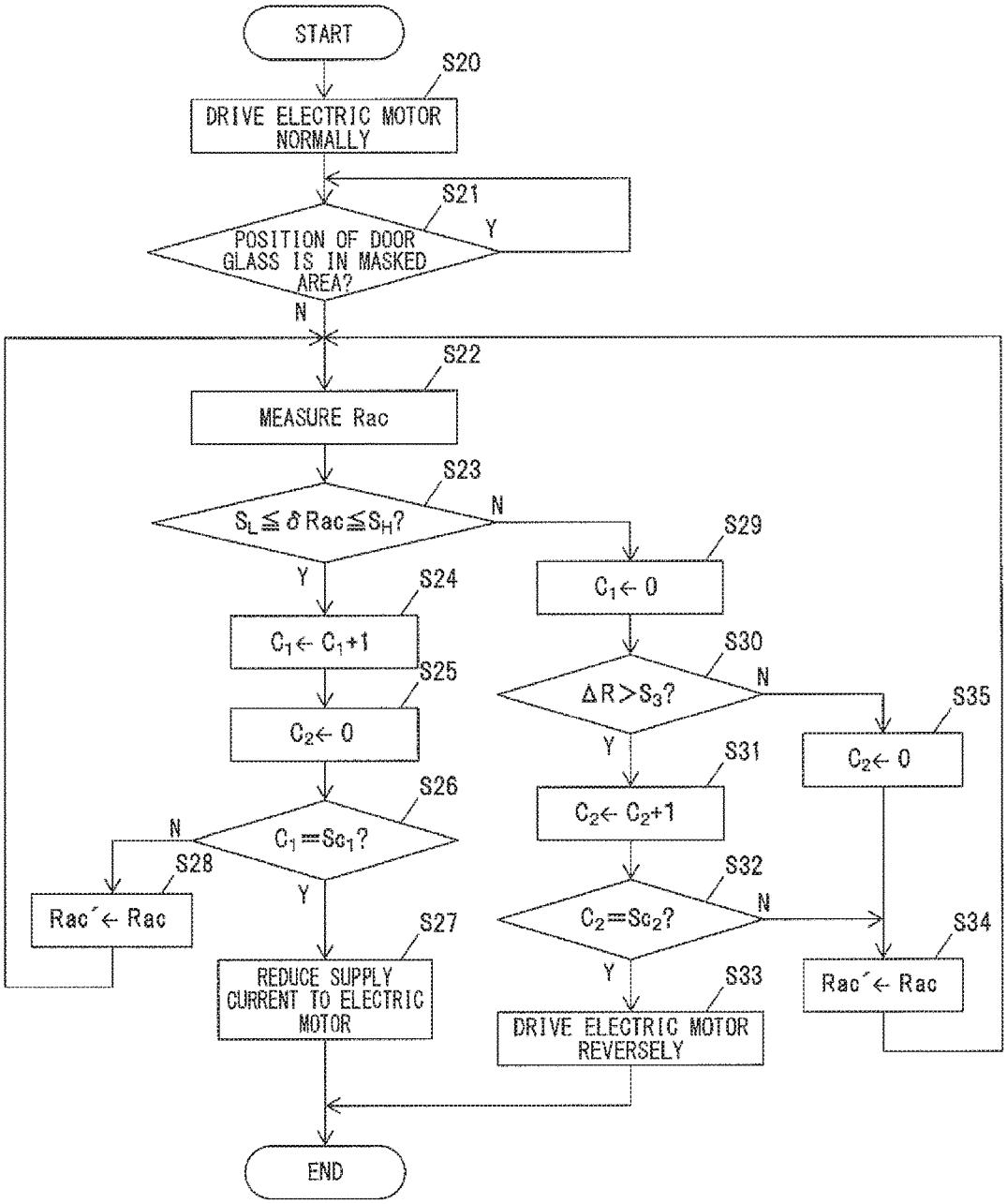
FIG. 9 is a flowchart showing an example of a process performed by the CPU in the second embodiment.

Next, a second embodiment of the present invention will be described below with reference to FIG. 9. The present embodiment is different from the first embodiment in the processing details that the CPU 40 in the control device 4 performs when the movement of the door glass 10 to the closing direction (lifted) by operating the switch 17 is commanded. However, the structures such as the door glass lifting device for the vehicle 100 are similar to the explanation in the first embodiment with reference to FIGS. 1 to 7D.

The process of the CPU 40 according to the present embodiment is invented so as to determine quickly whether the contact object is the foreign object or not with regard to the problem that the nipping of the foreign object is especially easy to cause if the inclination of the door glass 10 to the horizontal direction in lifting the door glass 10 is large.

Specifically, it takes relatively long time until the contact sensor 3 contacts the whole of the glass run 16 after detecting a part of the contact sensor 3 firstly detects the contact with the glass run 16 if the inclination of the door glass 10 is large. Thus, the determination time whether the Rac becomes statistically zero or not needs to be long, for example, by enlarging the specified number Sc in the step S17 shown in the flowchart in FIG. 8. And the time to reduce the supply current to the electric motor 24 becomes long. Thus, the lifted length of the door glass 10 while the foreign object contacts with contact sensor 3 and the door glass 10 begins to be lowered becomes longer if the contact object is the foreign object and the nipping may be easy to occur depending on the contact place of the foreign object with the contact sensor 3.

With regard to the problem, the contact object is determined as the seal lip of the glass run 16 (the vehicle interior side seal lip 164 and/or the vehicle exterior side seal lip 165), not the foreign object if the state that a time rate of change of the contact length $L_P$ at the contact place P, that is specifically, the absolute value of the time rate of change of the Rac continues for a specified time or longer in the present embodiment. That is to say, the contact object is determined as the foreign object when a variation of the contact length between the contact object and the contact sensor 3 is not more than the specified value.

Next, a specific example of the detail of the process which the CPU 40 performs will be described below on the basis of the flowchart in FIG. 9.

The CPU 40 outputs the command signal to the current output part 45 and the electric motor 24 begins to drive normally when the closing operation of the door glass 10 is commanded by operating the switch 17 by the driver etc. (the step S20). Next, the CPU 40 determines whether the position of the door glass 10 is within the specified masked area or not (the step S21). The CPU 40 samples the detecting signal from the ampere meter 42 at every specified sampling period (0.5 ms) and measures the Rac (the step S22) after the door glass 10 is lifted and escapes from the masked area (the step S21: No)

Next, the CPU 40 compares the Rac measured in the step S22 with the Rac which is measured in the last sampling period (Hereinafter, the last Rac is referred to as Rac'). Then the CPU 40 determines whether a change rate δRac (δRac=(Rac'−Rac)/Rac') is within specified range or not, that is, whether the δRac is not less than the first specified value $S_L$ and not more than the second specified value $S_H$ or not (the step S23). In the present embodiment, the first specified value $S_L$ which is the lower limit of the specified range is, for example, 4% and the second specified value $S_H$ which is the upper limit is, for example, 6%. Meanwhile these specified values should be set corresponding to the inclination of the door glass 10 in lifting the door glass 10.

As a result of the determination, if the δRac is within the specified range (S23: Yes), the CPU 40 increments a first counter $C_1$ (the step S24) and resets a second counter $C_2$ to zero (the step S25). The first counter $C_1$ is the counter so as to determine whether the state that the Rac is within the specified range continues or not. And the second counter $C_2$ is the counter value that is incremented in the step S31 described below, which is the counter so as to determine whether the state that the Rac measured in the step S22 keep having a significant difference of the resistance between the both ends of the second conductive member 332 or not.

Next, the CPU 40 determines whether the first counter $C_1$ is the specified number $Sc_1$ or not (the step S26). The specified number $Sc_1$ is 5 in the present embodiment. As a result of the determination, if the first counter $C_1$ is the specified number $Sc_1$ (S26: Yes), the CPU 40 determines that the contact object is the seal lip of the glass run 16 (the upper glass run 16*b*) and reduces the supply current to the electric motor 24 (the step S27). That is, the contact object is determined as the seal lip of the glass run 16 (the upper glass run 16*b*) if the state which the δRac is within the specified range continues for the specified time (0.5 ms×5 ($Sc_1$)=2.5 ms in the present embodiment).

Meanwhile, if the first counter $C_1$ is less than the specified number $Sc_1$ in the determination process in the step S26 (S26: No), the CPU 40 substitutes the Rac measured in the step S22 for the Rac' (the step S28) and repeats the process after the step S22 again.

And if the Rac is determined that it is not within the specified range in the determination process in the step S23 (S23: No), the CPU 40 resets the first counter $C_1$ to zero (the step S29), and determines whether the Rac measured in the step S22 has the significant difference for the resistance between the both ends of the second conductive member 332 or not, that is specifically, whether ΔR (ΔR=R1−Rac) that is the difference between the $R_1$ which is the resistance between the both ends of the second conductive member 332 and the Rac measured in the step S22 is larger than the specified value $S_3$ or not (the step S30). For example, the specified value $S_3$ is set in the value not more than 0.5% of the $R_1$.

In the determination process in the step S30, if the ΔR is larger than the specified value $S_3$ (S30: Yes), the CPU 40 increments the second counter $C_2$ (the step S31) and determines whether the second counter $C_2$ is the specified number $Sc_2$ or not (the step S32). The specified number $Sc_2$ is 3 in the present embodiment.

As a result of the determination, if the second counter $C_2$ is the specified number $Sc_2$ (S32: Yes), the CPU 40 determines that the contact object is the foreign object and drives the electric motor 24 reversely (S33). And the door glass 10 is lowered to the lower end. That is, the contact object is determined as the foreign object if the state that ΔR is more than the specified value $S_3$ continues for the specified period (0.5 ms×3 ($Sc_2$)=1.5 ms in the present embodiment).

Meanwhile, if the second counter $C_2$ is less than the specified number $Sc_2$ in the determination in the step S32 (S32: No), the CPU 40 substitutes the Rac measured in the step S22 for the Rac' (the step S34) and repeats the process after the step S22 again. And if the ΔR is less than the specified number $S_3$ in the determination process in the step S30 (S30: No), the CPU 40 resets the second counter $C_2$ to zero (the step S35), substitutes the Rac measured in the step S22 for the Rac' (the step S34) and repeats the process after the step S22 again.

According to the second embodiment described above, the contact object is determined as the seal lip of the glass run 16 (the upper glass run 16*b*), not the foreign body, if the state that the time rate of change of the Rac (the change rate δRac) corresponding to the time rate of change of the contact length $L_P$ at the contact place P is within the specified range (not less than the first specified value $S_L$ and not more than the second specified value $S_H$) continues for the specified time (2.5 ms in the present embodiment). And the CPU 40 determines that the contact object is the foreign object if the state that the Rac measured in the step S22 has the significant difference for the resistance between the both ends of the second conductive member 332 continues for the specified period. Hereby, the determination whether the contact object is the foreign object or not can be determined quickly if the inclination of the door glass 10 to the horizontal direction in lifting the door glass 10 is large.

[Third Embodiment]

Figure 10:
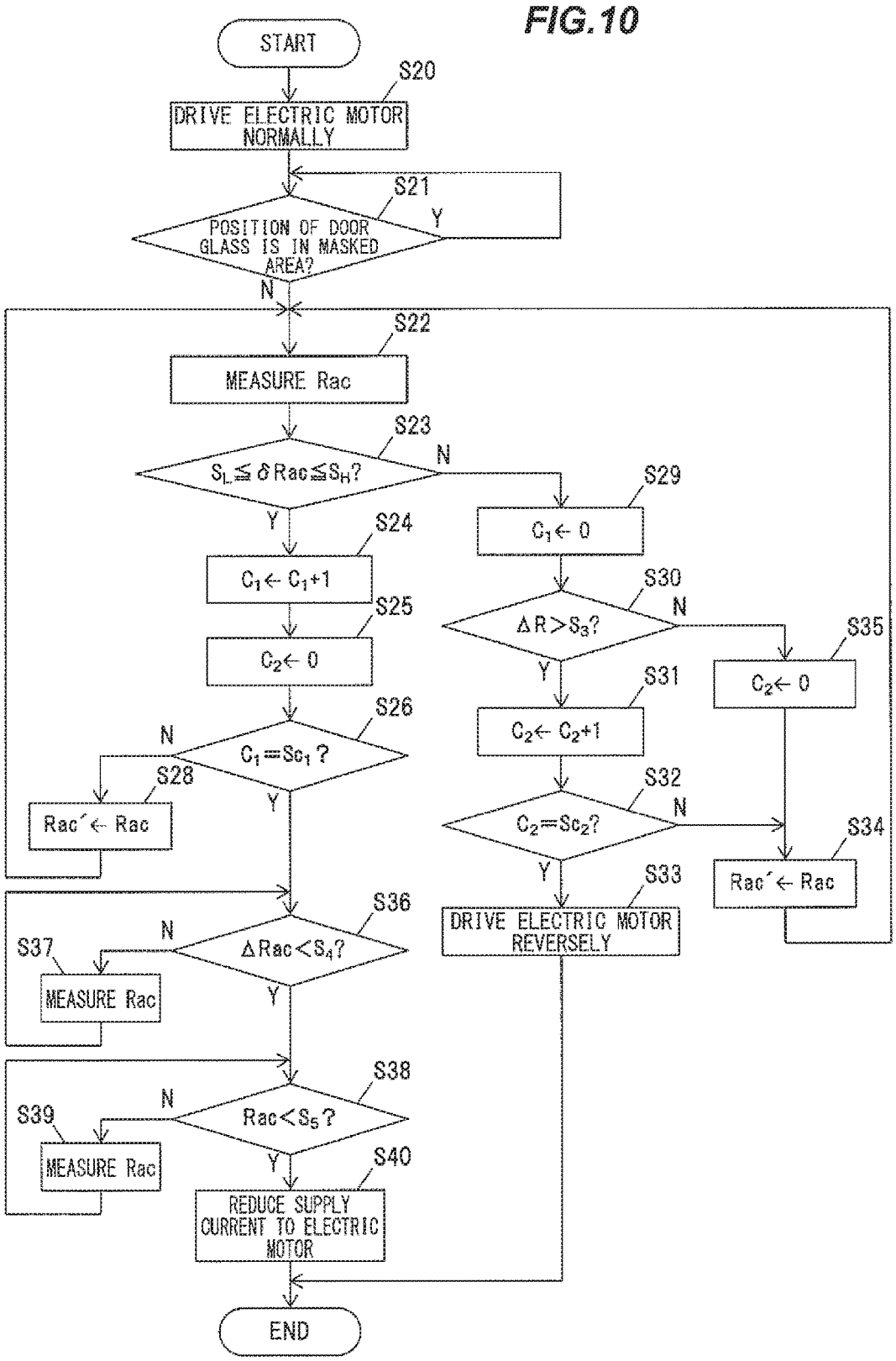
FIG. 10 is a flowchart showing an example of a process performed by the CPU in the third embodiment.

Next, a third embodiment of the present invention will be described below with reference to FIG. 10. The present embodiment continues the supply current to the electric motor 24 of the window regulator 2 which produces the driving force to drive the door glass 10 until the contact sensor 3 contacts with the bottom wall 161 of the glass run 16 and the door glass 10 is shut absolutely in the embodiment if the contact object is determined as the seal lip of the glass run 16.

The process which the CPU 40 performs in the present embodiment is common with the second embodiment except the difference in the process which determines the first counter $C_1$ is the specified number $Sc_1$ in the step S26, that is, the contact object is determined as the seal lip of the glass run 16 (the upper glass run 16*b*) from the process described with reference to the flowchart in FIG. 9 according to the second embodiment. The difference in the process will be specifically described below with reference to FIG. 10.

The CPU 40 determines whether the Rac is substantially equal to the resistance $R_1$ between the both ends of the second conductive member 332 or not, especially, whether the δRac which is the difference between $R_1$ and the Rac is less than the specified value $S_4$ or not (the step S36) if the first counter $C_1$ is determined as the specified number $Sc_1$ in the step S26 (S26: Yes). The determination process is the process so as to verify that the contact sensor 3 is moved upper after escaping the contact state between the contact sensor 3 and the seal lip of the upper glass run 16*b* (the vehicle interior side seal lip 164 and/or the vehicle exterior side seal lip 165). That is, the CPU 40 detects non-contact state with the seal lip because the vehicle interior side seal lip 164 and/or the vehicle exterior side seal lip 165 fails to contact the contact sensor 3 when the contact sensor 3 approaches the bottom wall 161 by lifting the door glass 10.

In the present embodiment, the specified value $S_4$ is a little value which is, for example, about 0.5 to 1.5% of the resistance ($R_1$) between the both ends of the conductive member 332.

As a result of the determination, the CPU 40 measures the Rac again (the step S37) and repeats the determination process in the step S36 again if the Rac is not substantially equal to the resistance ($R_1$) between the both ends of the second conductive member 332 (S36: No).

Also, as a result of the determination in the step S36, the CPU 40 determines whether the Rac is substantially zero or not, especially, whether the Rac is less than the specified value $S_5$ which is near to zero and is considered with a measurement error etc. or not (the step S38) if the Rac is substantially equal to the resistance ($R_1$) between the both ends of the second conductive member 332 (S36: Yes). And then the CPU 40 stops the supply current to the electric motor 24 (the step S40) if the Rac is substantially zero (S38: Yes). The specified value $S_5$ is the value so as to remove the effect of the error caused by the detecting signal etc. in the ampere meter 42 and is set to the little value which is not more than 0.5% of the $R_1$.

Meanwhile, the CPU 40 measures the Rac again (the step S39) and repeats the determination process in the step S38 again if the Rac is not substantially zero in the process in the step S38 (S38: No).

According to the process described above, supplying the current for the electric motor 24 which is identical with the current when the door glass 10 is lifted continues until contacting the contact sensor 3 with the bottom wall 161 of the glass run 16 after escaping the contact state between the contact sensor 3 and the seal lip of the upper glass run 16*b* (the vehicle interior side seal lip 164 and/or the vehicle exterior side seal lip 165). Thus, the door glass 10 is shut absolutely.

Although the first to third embodiments of the invention have been described, the invention according to claims is not to be limited to the embodiments. Further, it should be noted that all combinations of the features described in the embodiments are not necessary to solve the problem of the invention

INDUSTRIAL APPLICABILITY

The present invention can be applied to the door glass lifting device for the vehicle having the detection device to detect the nipping of the foreign object while the door glass for the vehicle is lifted.

Further, the various kinds of modifications can be implemented without departing from the gist of the invention. For example, materials, numerals and so on described in the first to third embodiments can be properly changed.

REFERENCE SINGS LIST

1 DOOR
2 WINDOW REGULATOR
3 CONTACT SENSOR
4 CONTROL DEVICE
10 DOOR GLASS
10*a* TOP END SURFACE
11 DOOR SASH (WINDOW FRAME)
16 GLASS RUN
100 VEHICLE DOOR GLASS LIFTING DEVICE
164 VEHICLE INTERIOR SIDE SEAL LIP
165 VEHICLE EXTERIOR SIDE SEAL LIP
331 FIRST CONDUCTIVE MEMBER
332 SECOND CONDUCTIVE MEMBER
333 SEPARATING MEMBER

The invention claimed is:

1. A vehicle door glass lifting device, comprising:

a lifting and lowering mechanism by which a door glass is lifted or lowered relative to a window frame of a vehicle door;

a contact sensor that is arranged on a top end surface of the door glass and extended along a longitudinal direction of the top end surface of the door glass; and a control part that controls the lifting and lowering mechanism, wherein the contact sensor can detect a contact state including a contact length with a contact object, and wherein the control part determines whether or not the contact object is a foreign object based on the contact state detected by the contact sensor, and wherein the control part lowers the door glass when the contact object is determined as the foreign object.

2. The device according to claim 1, wherein the control part determines whether or not the contact object is the foreign object at least by a condition that the contact length with the contact object detected by the contact sensor is not more than a predetermined value.

3. The device according to claim 1, wherein the control part detects the contact state at every predetermined period and determines whether or not the contact object is the foreign object based on a plurality of determination results of the contact length after the contact with the contact object is detected.

4. The device according to claim 3, wherein the control part determines that the contact object is the foreign object if a variation of the contact length in the plurality of determination results is not more than a predetermined value.

5. The device according to claim 1, wherein the control part reduces a current supplied to an electric motor that generates a driving force to drive the door glass in the lifting and lowering mechanism if the control part determines that the contact object is a seal lip of a glass run.

6. The device according to claim 1, wherein the control part continues to supply a current to an electric motor that generates a driving force to drive the door glass in the lifting and lowering mechanism until the contact sensor contacts a bottom wall of a glass run if the control part determines that the contact object is a seal lip of the glass run.

7. The device according to claim 1, wherein the control part determines that the contact object is not the foreign object if a state that a time rate of change of the contact length falls within a predetermined range continues for a predetermined time.

8. The device according to claim 1, wherein the contact sensor comprises a first conductive member arranged along a longitudinal direction of the top end surface of the door glass, a second conductive member arranged in parallel to the first conductive member and having a resistance value per unit length larger than the first conductive member, and a separating member that separates the first conductive member and the second conductive member so as to be contactable with and separable from each other, wherein the contact sensor is configured so as to contact the first conductive member with the second conductive member at a contact position with the contact object, and wherein the control part detects the contact length between the contact object and the contact sensor based on an electric resistance between both ends in a longitudinal direction of the second conductive member.

* * * * *